United States Patent [19]

King et al.

[11] 4,437,984

[45] Mar. 20, 1984

[54] MULTIPLE HYDROCYCLONE APPARATUS

[75] Inventors: Stephen J. King, Clearwater; Bruce S. Moffatt, Largo; John C. Stewart, St. Petersburg, all of Fla.

[73] Assignee: Clark & Vicario Corporation, Pinellas Park, Fla.

[21] Appl. No.: 365,773

[22] Filed: Apr. 5, 1982

[51] Int. Cl.[3] ..... B03D 45/12

[52] U.S. Cl. ..... 209/211; 55/191; 55/346; 210/512.2

[58] Field of Search ..... 55/191, 346–349; 209/211, 144; 210/512.2

[56] References Cited

U.S. PATENT DOCUMENTS

| | | | |
|---|---|---|---|
| 3,147,099 | 9/1964 | Burdock | 55/346 |
| 3,421,622 | 1/1969 | Wurtmann | 209/211 |
| 4,146,469 | 3/1979 | Kaiser et al. | 209/211 |
| 4,148,721 | 4/1979 | Brown et al. | 55/349 |
| 4,190,014 | 2/1980 | Jenkins et al. | 55/341 NT |

FOREIGN PATENT DOCUMENTS 2044817A 10/1980 United Kingdom .

*Primary Examiner*—Bernard Nozick

*Attorney, Agent, or Firm*—Vogt & O'Donnell

[57] ABSTRACT

Multiple hydrocyclone apparatus including plural loop-like arrays of hydrocyclones is provided with a walk-way space inside the innermost array. A passageway is provided to permit entry of an operator into the walk-way space for inspection and repair of the inner hydro-cyclones. The apparatus may be made in an elongated form to fit available mounting space. Baffles may be provided within the feed plenum for directing the flow of feed stock. Appropriate devices may be provided for bleeding minor portions of the feed stock from the feed plenum to maintain the velocity of the stock flowing within the plenum.

27 Claims, 10 Drawing Figures

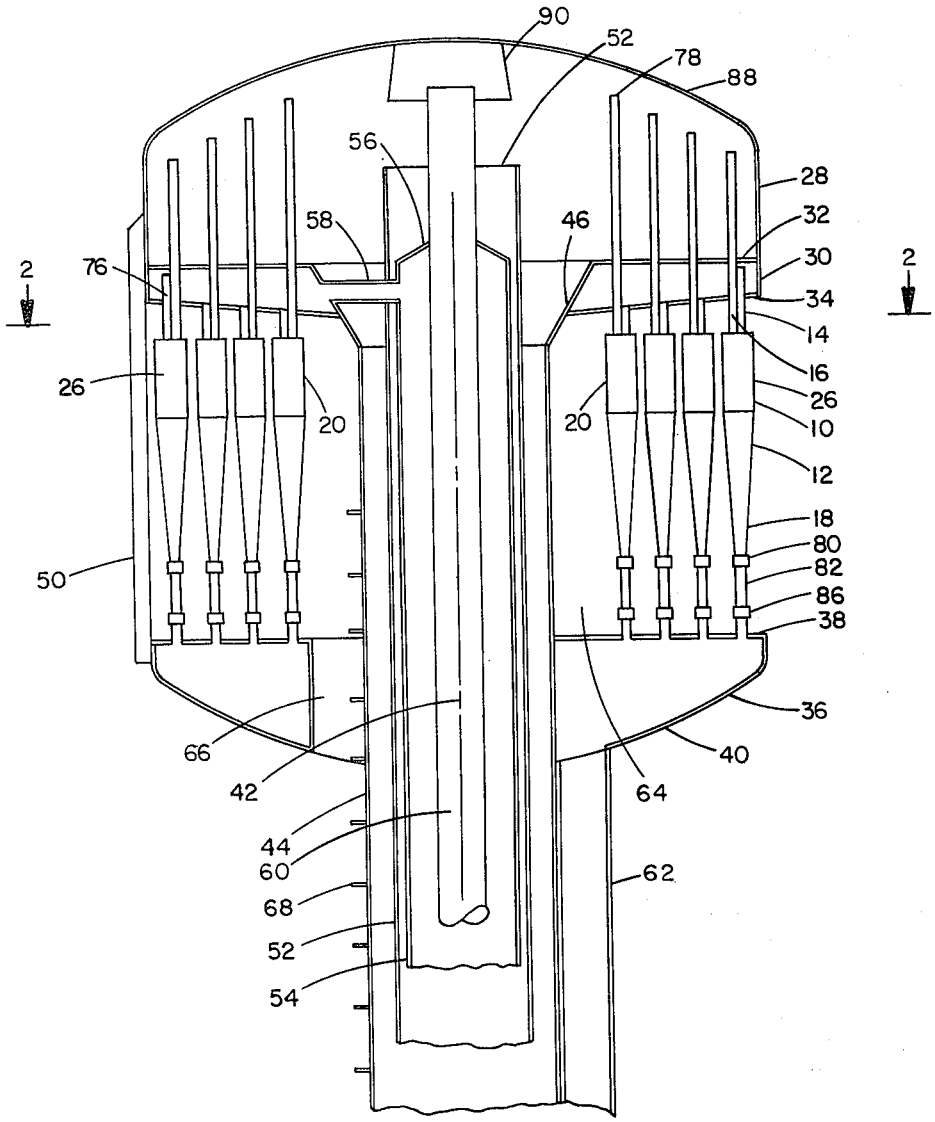
FIG. 1
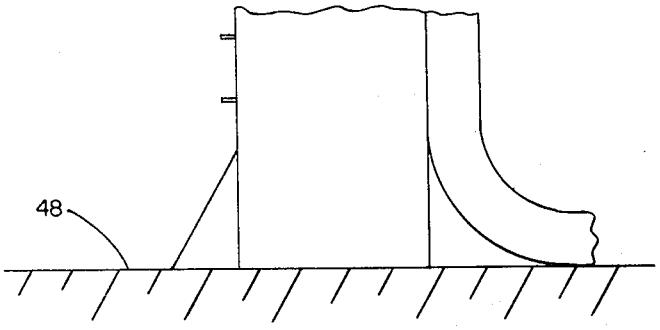

MULTIPLE HYDROCYCLONE APPARATUS

BACKGROUND OF THE INVENTION

The present invention relates to multiple hydrocyclone apparatus.

In the paper-making industry, and in related industries, hydrocyclones are used for removing contaminants from liquids. For example, paper stock consisting of a suspension of cellulose fibers in water is ordinarily cleaned before it is fed to a paper-making machine. As is well known to those skilled in the art, a hydrocyclone is a device having a hollow body, an inlet to the interior of the body and two outlets from the interior of the body. The interior of the hydrocyclone body is configured so that stock entering through the inlet flows in a swirling pattern within the body and centrifugal forces within the swirling flow segregate various portions of the stock according to their relative densities. The lighter fraction exits from the hydrocyclone through one of the outlets and the heavier fraction through the other. Thus, if the contaminants to be separated from the stock are of lower density than the stock itself, the higher density fraction exiting through one outlet will contain relatively little of such contaminants. The lighter fraction of the stock containing the majority of the contaminants is either discarded or sent to a further cleaning operation. More commonly, the contaminants to be separated are of higher density than the stock itself so that the higher density fraction contains most of the contaminants and the lower density fraction is relatively contaminant-free. The terms "accept" and "accepted stock", as used in this disclosure, refer to the relatively contaminant-free portion of the stock, and the terms "reject" and "rejected stock" refer to the more contaminated portion of the stock.

Because individual hydrocyclones are ordinarily limited in size and flow capacity, batteries or assemblies including hundreds of individual hydrocyclones are utilized to process stock at the tremendous rates required by modern, high speed industrial operations. For example, apparatus for cleaning paper-making stock at the rate of thirty thousand gallons per minute may include 200 individual hydrocyclones, all connected to a common source of feed stock and all discharging in parallel to common receivers for accepted stock and rejected stock.

The mounting and connection of the numerous individual hydrocylones in such apparatus have posed significant problems. The efficiency of each hydrocyclone in separating the desirable and undesirable fractions of the stock may be affected by fluctuations in the flow of feed stock and by fluctuations in pressure or vacuum conditions at the outlets of the hydrocyclone. Also, the cost of the energy required to pump stock through the apparatus is significant, and complex, flow-restrictive piping arrangements tend to increase this cost. The cost of the initial installation is also a significant problem. Such problem is especially severe in the case of hydrocyclone apparatus for treating stocks, such as paper-making stocks, which are abrasive and corrosive. The fluid-handling elements of such apparatus must ordinarily be fabricated from expensive, difficult-to-work materials such as stainless steel. Accessibility of the individual hydrocyclones for inspection, repair or replacement is also a significant consideration.

The physical orientation of the individual hydrocyclones is also important. The efficiency of some hydrocyclones may be improved if the body of the hydrocyclone is oriented vertically. Thus, in those cases where the lighter fraction of the stock is the accept or desired fraction, the accept outlet of each hydrocyclone should be at the top and the reject outlet at the bottom so that gravity aids in separating the heavy contaminants from the accepted stock. Such vertical orientation of the hydrocyclones is particularly desirable where the apparatus combines the cleaning action of the hydrocyclones with deaeration. In such apparatus, the accept outlets of the individual hydrocyclones may be connected to individual spray pipes extending upwardly into a common accept receiver or plenum which is maintained under vacuum. Accepted stock exiting from the accept outlet or each hydrocyclone sprays upwardly into the plenum, forming relatively finely divided streams or droplets, thus intimately exposing the stock to the vacuum in the plenum to facilitate removal of air contained in the stock.

Compactness of the apparatus is also an important consideration in mounting the apparatus within the mill and in shipping the apparatus to the mill for installation. The need for compactness is especially acute in apparatus employing a vacuum plenum as the receiver for accepted stock. The collapsing forces on such an evacuated plenum imposed by the atmospheric pressure surrounding it increase markedly as the size of the plenum increases. Moreover, such apparatus is often mounted high above the factory floor so that the accepted stock may flow by gravity from the accept plenum to the equipment where it is utilized. This arrangement often necessitates placing the hydrocyclone apparatus adjacent the roof of the factory building, in the limited space available between the roof supporting trusses or columns of the building. Further, the size of any hydrocyclone apparatus mounted at an elevated location should be minimized to minimize the weight of the apparatus and the weight of stock contained in the apparatus and thus minimize the cost of the supporting structure.

One form of multiple hydrocyclone apparatus which has been developed to meet these requirements is described in co-pending, commonly assigned United States patent application Ser. No. 021,623, filed Mar. 19, 1979. As described in said application, the hydrocyclones may be mounted in side-by-side vertical orientation, with their accept outlets at the top and their reject outlets at the bottom. The hydrocyclones are disposed in concentric circular arrays. One or more pipes or conduits extend upwardly adjacent the center of the hydrocyclone arrays to an accept manifold or receiver, mounted above the hydrocyclones. The accept manifold or receiver may be in the form of a unitary cylindrical plenum. A reject receiver or manifold, which also may be in the form of a unitary plenum, may be mounted beneath the hydrocyclones and a feed manifold may be provided adjacent the accept manifold, near the top of the hydrocyclones. The central pipes or conduits serve both as fluid connecting elements and as structural supports for the accept manifold. Moreover, continuations of the centrally disposed conduits extending downwardly below the reject receiver may serve as pedestal supports for the entire apparatus. Each hydrocyclone may be provided with a sight glass at its reject outlet so that the flow from each may be observed and the need for servicing detected by such observation.

This arrangement satisfies the aforementioned requirements to a substantial degree. However, there is still a need for even further improvement in several respects.

The inner hydrocyclones are surrounded by the reject manifold beneath them, the accept manifold or plenum on top of them and the outer arrays of hydrocyclones alongside them. It is therefore difficult to inspect the sight glasses associated with the inner hydrocyclones. It is also difficult to remove or repair any of the inner hydrocyclones without first removing some of the hydrocyclones in the outer arrays. Also, the round shape of the apparatus according to said application creates certain difficulties when especially large numbers of hydrocyclones are to be utilized. As the diameter of the apparatus, i.e., the diameter of the accept receiver or plenum, is directly related to the number of hydrocyclones in the apparatus, apparatus incorporating especially large numbers of conventionally-sized hydrocyclones (more than about 200) requires a receiver or plenum diameter in excess of 12 feet. Such large-diameter receivers may not fit within the spaces commonly provided between roof trusses or columns in factory buildings. Also, they cannot conveniently be transported by truck or railroad.

SUMMARY OF THE INVENTION

The present invention provides apparatus which substantially improves the visibility and accessibility of the hydrocyclones, as compared with apparatus referred to above, but which still retains the desirable features of such apparatus.

Additionally, apparatus according to one aspect of the present invention can be provided with more hydrocyclones without exceeding the dimensions of the available mounting space or the maximum desirable dimensions for truck or railroad shipment.

The improved apparatus according to the present invention may include a plurality of elongated hydrocyclones disposed in vertical orientation side by side with one another in a plurality of loop-like arrays. The apparatus may also include means for conducting feed stock to the inlets of the hydrocyclones, means for conducting rejected stock from the reject outlets of the hydrocyclones and means for conducting accepted stock from the accept outlets of the hydrocyclones. The various conducting means include manifolds, at least one of the manifolds preferably being disposed below the hydrocyclones and at least one of the manifolds preferably being disposed above the hydrocyclones. The present apparatus also may include a vertically-extensive conduit in the space bounded by the innermost array of hydrocyclones. For example, if the various arrays of hydrocyclones are concentric circular arrays, the conduit may be aligned with the common central axis of the various arrays. The conduit may also serve as a physical support for the manifold positioned above the hydrocyclones, and an extension of the conduit may serve as a pedestal support for the entire apparatus. In these respects, the apparatus according to the present invention is similar to the apparatus described above.

In the apparatus according to the present invention however, the hydrocyclones of the innermost array may be disposed at a sufficient distance from the conduit to provide a walkway space large enough to accommodate a human operator. Access means may also be provided for permitting entry of an operator to the walkway space from outside of the apparatus without removal of any of the hydrocyclones. Thus, an operator can enter into the walkway space and examine the inner hydrocyclones and any sight glasses associated therewith. Because the arrays of hydrocyclones may be serviced both from the inside and the outside, the number of hydrocyclones which must be removed in order to reach a particular hydrocyclone in need of repair or replacement is materially reduced. For example, in conventional apparatus utilizing four concentric arrays of hydrocyclones, it would ordinarily be necessary to remove at least two hydrocyclones in the outer two arrays in order to reach a defective hydrocyclone in the third array. By contrast, using apparatus which includes the walkway space and access means, it would only be necessary to remove one good hydrocyclone from the innermost array to reach the same defective unit. Such apparatus according to the present invention thus provides substantial savings in repair and maintenance time.

Although it would appear that the walkway space in the present apparatus would occupy an area which could otherwise be filled with hydrocyclones, it has surprisingly been found that this is not the case. The present invention incorporates the realization that the space immediately adjacent the conduit is normally devoid of hydrocyclones in any event and thus normally wasted. In those installations wherein the conduit serves as a structural support for a manifold positioned above the hydrocyclones, structural reinforcements or braces extending outwardly from the conduit must often be provided at the juncture of the conduit with the manifold. Moreover, it is often desirable to provide the conduit with a funnel-like transition section flaring radially outwardly of the conduit adjacent the juncture of the conduit and the manifold to facilitate flow of stock from the manifold to the conduit. The transition section may also serve as the structural reinforcement. Such features often preclude the use of the space adjacent the conduit for additional hydrocyclones. None of these features, however, precludes use of the area adjacent the conduit as a walkway space. Ordinarily, the reinforcing or transition structures are located adjacent the top of the hydrocyclones out of the way of an operator working in the walkway space. Thus, in apparatus according to this aspect of the present invention, space which has heretofore been wasted is put to good use.

According to another aspect of the present invention, the overall shape or plan of the apparatus may be of an elongated form having two opposite poles rather than the unipolar cylindrical form utilized heretofore. One such elongated or dipolar form which may be utilized is a so-called "obround" form. As used herein, the term "obround" refers to an elongated shape bordered at each end by a semi-circle and on each side by a straight line tangent to both semi-circles. Thus, the "obround" shape is similar to the shape of an ordinary racetrack. The centers of the two end semi-circles of the obround constitute the poles of the obround.

Apparatus of obround plan according to the present invention may include an accept receiver or plenum of obround plan and a plurality of hydrocyclone arrays, each in the form of an obround loop. The poles of each hydrocyclone array are aligned with the corresponding poles of the other hydrocyclone arrays. Also, the poles of the obround accept plenum may be aligned with the poles of the hydrocyclone arrays. In contrast to the unipolar round apparatus utilized heretofore, the various conduits leading upwardly through the space bounded by the loop-like hydrocyclone arrays are ordinarily not disposed adjacent a single center. Rather, one such conduit may be disposed in alignment with one pole of the apparatus (in alignment with one pole of the receiver or plenum) and another such conduit may be disposed in alignment with the opposite pole of the apparatus. The hydrocyclones of the innermost array adjacent one such conduit thus define a first walkway space and the hydrocyclones of the innermost array adjacent the conduit at the other pole define a second walkway space. These two spaces may be connected to one another so that an operator may pass from one to the other to inspect and service various portions of the apparatus.

This arrangement offers several advantages, especially in those cases where the apparatus must incorporate large numbers of hydrocyclones. First, the length of the apparatus may be increased to accommodate many hydrocyclones without increasing the width of the apparatus. The apparatus does not become too wide for placement within the space between adjacent roof supporting trusses of a building or for convenient truck or railway shipment. Additionally, when an obround arrangement is utilized, the pattern of hydrocyclone arrangements along the sides of the apparatus can be a simple repeating pattern. Therefore, the apparatus can be made in various lengths to accomodate various numbers of hydrocyclones with only the simplest revisions to the specifications and tooling utilized in fabrication.

Other objects, features, and advantages of the present invention will be more readily apparent from the detailed description of the preferred embodiments set forth below when taken in conjunction with the accompanying drawings.

BRIEF DESCRIPTION OF THE DRAWINGS

FIG. 1 is a sectional view of apparatus according to one embodiment of the present invention.

DETAILED DESCRIPTION OF THE EMBODIMENTS

Figure 2:
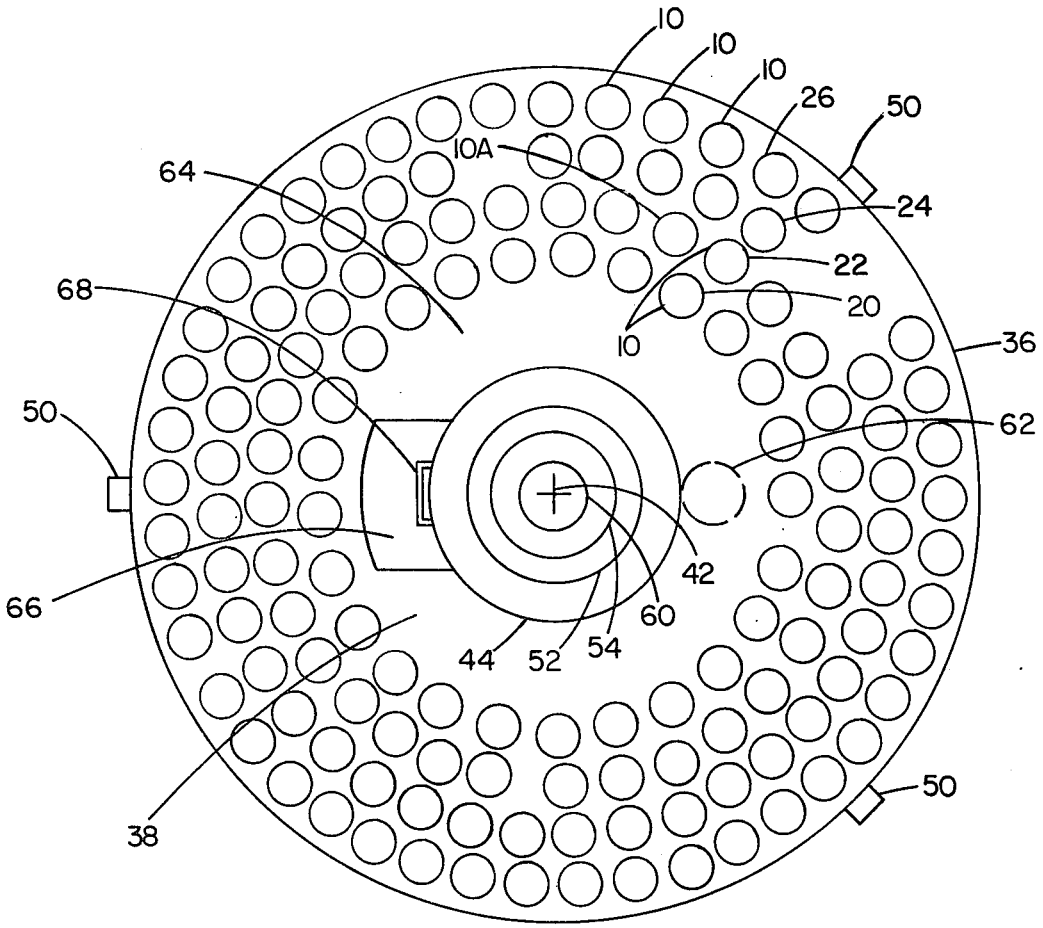
FIG. 2 is a sectional view taken along line 2—2 in FIG. 1.
Figure 3:
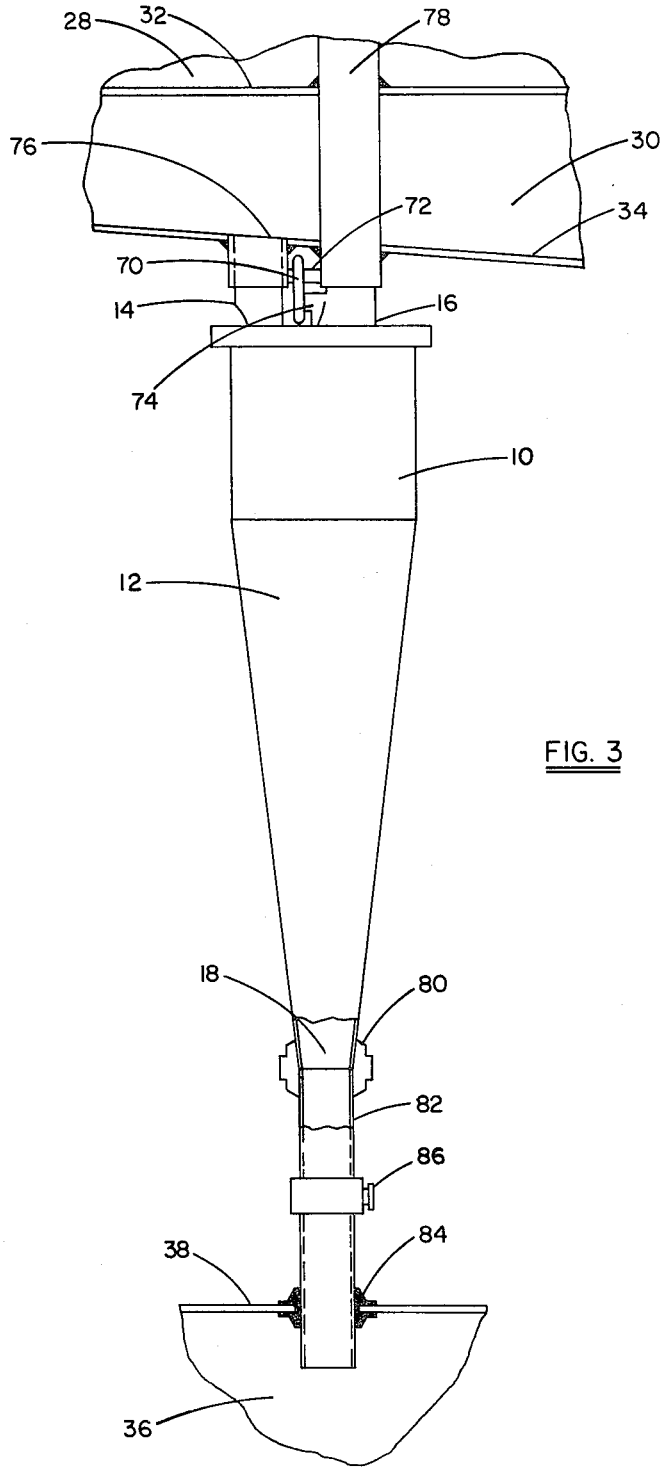
FIG. 3 is a fragmentary view of an enlarged scale illustrating a portion of the apparatus shown in FIGS. 1 and 2.

As illustrated in FIGS. 1, 2 and 3, apparatus according to a first embodiment of the present invention includes a plurality of hydrocyclones 10, each of which has an elongated body 12, an inlet 14 and an accept outlet 16 at one end and a reject outlet 18 at the opposite end. The hydrocyclones are mounted so that the body of each hydrocyclone extends vertically with reject outlet 18 at the bottom. The hydrocyclones are disposed side by side with one another in four concentric circular arrays including an innermost array 20, intermediate arrays 22 and 24 and an outermost array 26.

The apparatus also includes an accept manifold 28 in the form of a generally cylindrical plenum positioned above the hydroyclones. A feed manifold 30, also in the form of a generally cylindrical plenum is positioned immediately beneath accept plenum 28 but above the hydrocyclones, the interiors of plenums 28 and 30 being separated from one another by a common wall 32 serving as both the bottom wall of plenum 28 and the top wall of plenum 30. As common wall 32 is horizontal and the bottom wall 34 of the feed plenum slopes upwardly towards the periphery of the apparatus, the vertical extent of the feed plenum 30 decreases gradually toward the periphery of the device.

A reject plenum 36 is disposed beneath the hydrocyclones. Reject plenum 36 has a flat, horizontal top wall 38 and a generally cup-shaped, dished bottom wall 40. Each of the plenums 28, 30 and 36 is generally in the shape of a solid of revolution about a vertical axis. Thus, each of said plenums is circular when seen in plan view. For example, plenum 36 is shown in plan in FIG. 2. The axes of these plenums are coincident with one another and such axes are aligned with the common center 42 of the hydrocyclone arrays.

An accept outlet pipe or conduit 44 extends downwardly from accept plenum 28 through feed plenum 30 and through the space bounded by the innermost array 20 of hydrocyclones, the axis of conduit 44 being aligned with the common center 42 of the hydrocyclone arrays. A funnel-like transition section 46 connects conduit 44 with the accept plennum, the wide end of the transition section being disposed at its juncture with wall 32 and the narrow end of the transition section being disposed at the juncture of the transition section with the conduit 44. The lower portion of conduit 44 extends downwardly beneath reject manifold 36 and serves as a pedestal to support manifolds 28 and 30 in an elevated position, above the floor 48 of the building in which the apparatus is installed. Transition section 46 serves as a structural reinforcement at the connection between conduit 44 and the lower wall 32 of manifold 28. Reject plenum 36 is supported by a plurality of braces 50 (FIGS. 1 and 2) at the periphery of the apparatus.

An accept overflow pipe 52 is disposed within conduit 44 and extends to a level above bottom wall 32 of manifold 28. A feed conduit 52 extends within overflow pipe 52 to a blind or closed end 56 adjacent feed manifold 30, feed conduit 54 communicating with the interior of the feed manifold via a plurality branch conduits 58, of which only one is visible in FIG. 1. Each branch conduit extends radially outwardly from feed conduit 54 through the wall of overflow pipe 52 and through the wall of transition section 46. A vacuum connection pipe 60 extends within feed pipe 54 and extends beyond blind end 56 to an upper terminus adjacent the top of accept plaenum 28. A reject outlet pipe 62 extends alongside pipe 44 and communicates with the interior of reject manifold 36.

There is a clearance between the hydrocyclones of innermost array 20 and the wall of conduit 44, so that such hydrocyclones and such conduit cooperatively define a walkway space 64 extending around conduit 44 above reject manifold 36, the walkway space being of sufficient size to accomodate a human being. That portion of the upper wall 38 of reject manifold 36 which is disposed beneath the walkway space serves as a floor for such space so that an operator working within the walkway space may stand on wall 38. A psaaageway 66 extends vertically through reject manifold 36 adjacent conduit 44 so that an operator may enter space 64 without removing any of hydrocyclones 10. Rungs 68 are attached to the wall of conduit 44 and serve as a ladder for access to space 64.

As best illustrated in FIG. 3, each of hydrocyclones 10 is physically supported from the lower wall 34 of the manifold 30 by a hook 70 releasably engaged with a bracket 72 fixed to the lower wall 34 of feed plenum 30 and with another bracket 74 fixed to the body 12 of such hydrocyclone. The inlet 14 of each hydrocyclone is releasably engaged with an inlet nipple 76 extending through wall 34 and communicating, at its upper end, with the interior of feed plenum 30. All of the inlet nipples 76 terminate substantially flush with the top surface of wall 34, except that those inlet nipples adjacent the periphery of the device extend upwardly into feed plenum 30.

The accept outlet 16 of each hydrocyclone is releasably engaged with the lower end of the associated spray pipe 78. Each spray pipe 78 extends through feed plenum 30 to an upper terminus (FIG. 1) within accept plenum 28, the upper terminus of each spray pipe 78 being disposed at a level higher than the upper terminus of overflow pipe 52. As shown in FIG. 3, each spray pipe is welded to the bottom wall 34 of feed plenum 30 and to the common wall 32 between the feed and accept plenums so as to structurally connect these walls to one another.

The reject outlet 18 at the lower end of each hydrocyclone is releasably connected, via a flexible bushing 80, to a clear tubular conduit or sight glass 82. Each sight glass extends through a resilient sealing ring 84 into the interior of reject plenum 36. A collar or clamp 86 is engaged with each sight glass 82 so that the sight glass cannot accidentally drop into the interior of reject plenum 36.

During operation of the apparatus, a vacuum is applied to accept plenum 28 by an appropriate vacuum pump (not shown) connected to vacuum pipe 60. Stock to be processed is forced upwardly through feed pipe 54, through branch conduits 58 and into feed plenum 30, wherein the stock flows radially outwardly, toward the periphery of the apparatus. As the flowing stock passes each array of hydrocyclones, a portion of the stock enters the hydrocyclones of such array. Because successive portions of the stock are removed as the flow passes towards the periphery of the apparatus, the volume of stock flowing within the feed plenum decreases toward the periphery of the plenum. Because the interior height of plenum 30 decreases toward the periphery, the decreasing flow is confined within a progressively narrowing space, thus maintaining the velocity of the flowing stock above the desired minimum value as it passes from the center of the plenum to the outermost array of hydrocyclones. This arrangement is useful in minimizing settlement of solids from the stock within the feed chamber. Any pockets of air which may accumulate in feed plenum 30 will rise to the top of the feed plenum and pass into the upwardly extending inlet nipples 76 adjacent the periphery of the plenum. Because the upwardly-extending inlet nipples are disposed in a zone of relatively low flow velocity in the feed plenum, they do not seriously obstruct the flow of stock in the feed plenum.

The stock entering each hydrocyclone via the associated inlet nipple 76 flows in a swirling pattern within the body of the hydrocyclone so that it is separated into a relatively low density accept fraction and a relatively high density reject fraction. The rejected stock from each hydrocyclone passes through the reject outlet 18 (FIG. 3) of such hydrocyclone and into reject plenum 36 from which it exits via reject drain pipe 62. The rejected stock may be sent to an additional separating operation, the relatively contaminant-free portion of such stock being recycled and blended with the feed to the initial cleaning apparatus.

Accepted stock from each hydrocyclone flows upwardly through the accept spray pipe 78 associated therewith and sprays upwardly into the interior of accept plenum 28, where it impinges upon the upper wall 88 of such plenum and breaks into numerous, finely divided streams and droplets, thus effectively exposing all of the accepted stock to the partial vacuum in the upper part of the accept plenum and thereby removing air from the stock.

The deaerated stock falls downwardly within accept plenum 28, collects as a pond at the bottom of the accept plenum and exits from the apparatus via transition section 46 and accept outlet pipe 44, passing around the exterior of branch conduits 58. The funnel-like shape of transition section 46 aids in preventing vortexing in the stock entering conduit 44. Such vortexing would be undesirable because it could reintroduce gas bubbles into the stock. The bottom end of accept outlet pipe 44 is connected via an appropriate piping arrangement (not shown) to the device where the accepted stock is processed as, for example, to the head box of a paper-making machine.

Variations in the level of the pond of stock within accept plenum 28 would result in variations in the hydrostatic head and thus cause variations in the flow of accepted, deaerated stock to the processing machine. To minimize such variations, the apparatus is ordinarily operated in such fashion that the total flow of accepted stock entering accept plenum 28 through spray pipes 78 is greater than the normal flow rate of accepted stock to the processing machine via conduit 44. Thus, the stock accumulates until the pond level reaches the level of the top of overflow pipe 52 and the pond level stabilizes at such point, with the excess portion of the accepted stock flowing over the top edge of pipe 52 and draining from the apparatus through such pipe. The overflowing accepted stock is mixed with the feed stock and reprocessed.

Air removed from the stock passes from the accept plenum through vacuum pipe 60. A skirt-like baffle 90 surrounding the upper end of such pipe prevents stray droplets of stock and stray fibers from the stock from being drawn into the vacuum pipe along with the air. Appropriate precondenser means (not shown) may be provided for chilling the air prior to its entry into the vacuum pipe so as to condense some of the water vapor contained therein and thus prevent entry of such water vapor into vacuum pipe 60. Such condenser means may include, for example a spray head arranged to spray a relatively minor amount of cold water downwardly outside of vacuum pipe 60 but within baffle 90. When this arrangement is used, water vapor in the air condenses on the sprayed droplets of cold water which fall into overflow pipe 52 and blend with the overflowing accepted stock.

During operation of the apparatus, plugs consisting of contaminants, fibers from the stock or both may form in one or more of the hydrocyclones. Such plugs normally collect at the narrow end of the body of the affected hydrocyclone adjacent the reject outlet 18. A plug may partially or totally block the flow of rejected stock from the affected hydrocyclone. This adversely affects the efficiency of the apparatus, as at least some of the undesirable, contaminant-rich portion of the stock passing through any affected hydrocyclone will exit from such hydrocyclone along with the desired fraction via the associated spray pipe 78, thus carrying the contaminants into the accepted stock.

With the present apparatus, such plugging can be detected readily by periodic inspection of the sight glasses 82. An operator may inspect the sight glasses associated with the hydrocyclones of innermost array 20 and the adjacent intermediate array 22 by entering the walkway space 64. The sight glasses associated with the hydrocyclones of outermost array 26 and outer intermediate array 24 may be inspected by an operator standing on a ladder or elevated platform at the periphery of the apparatus. Once the plugging condition has been detected, the affected hydrocyclones may be disconnected readily and manually cleared. For example, if hydrocyclone 10*a* of inner intermediate array 22 must be removed from the apparatus and replaced, this can be accomplished by personnel working in the walkway space 64. Only the immediately adjacent hydrocyclone of innermost array 20 need be removed. By contrast, if walkway space 64 were not provided, or if it were impossible to gain access to such space, it would be necessary to remove at least two hydrocyclones (one from outermost array 26 and another from outer intermediate array 24) in order to service hydrocyclone 10*a*.

Figure 4:
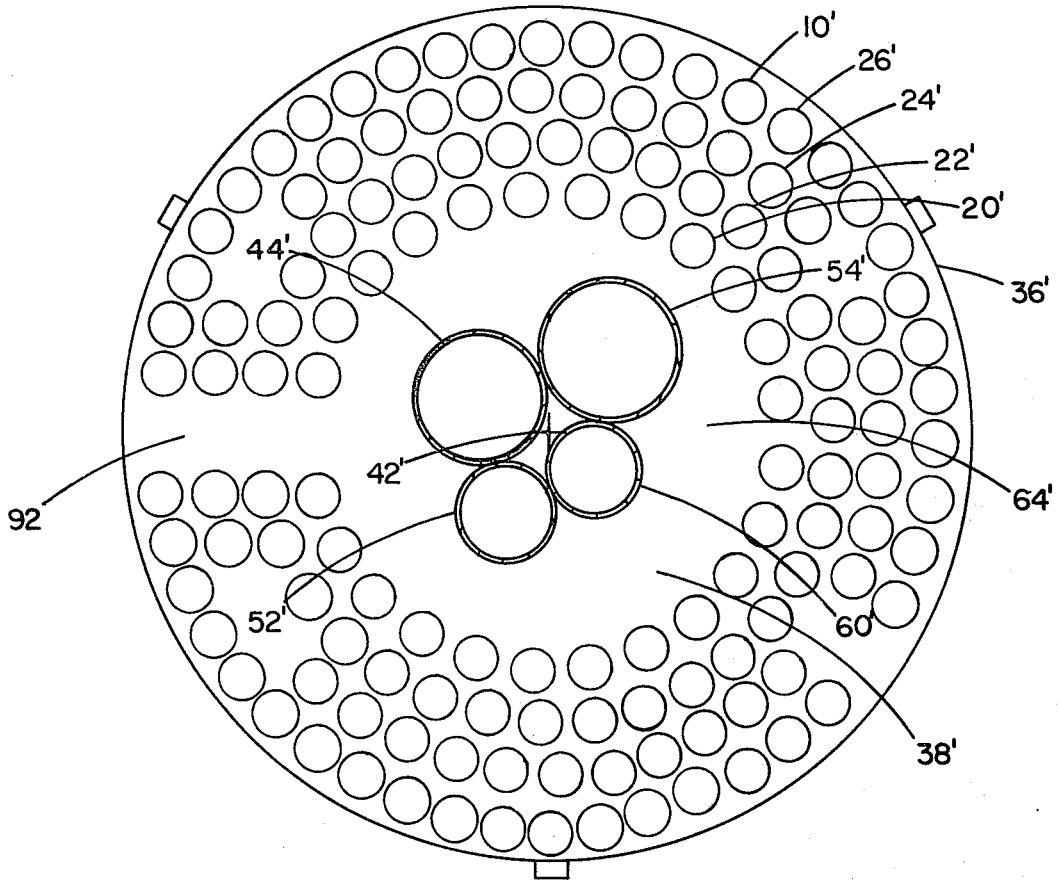
FIG. 4 is a sectional view similar to FIG. 2 but depicting apparatus according to a second embodiment of the present invention.

The apparatus illustrated in FIG. 4 is similar to that described above with reference to FIGS. 1 through 3. It includes four concentric arrays 20', 22', 24' and 26' of hydrocyclones 10', a reject plenum 36' disposed beneath the hydrocyclone arrays and accept and feed plenums (not shown) disposed above the hydrocyclone arrays. An accept outlet pipe 44', accept overflow pipe 52', and vacuum pipe 60' extend vertically through the space bounded by innermost hydrocyclone array 20' adjacent the common center 42' of the hydrocyclone arrays and a feed pipe 54' extends to the feed manifold adjacent the accept outlet and vaccum pipes. Unlike the apparatus described above, the various pipes extending vertically through the interior of the apparatus are not concentric with one another. Feed pipe 54' obstructs the walkway space 64', the space between the wall of the feed pipe and the adjacent hydrocyclones of the innermost array being insufficient to permit passage of an operator therebetween. Feed pipe 54' thus interrupts walkway space 64'. However, walkway space 64' still provides improved access to the hydrocyclones of the inner arrays. Even in the vicinity of feed pipe 54', an operator standing adjacent feed pipe 54' can still inspect the hydrocyclones of the inner arrays and the sight glasses associated therewith and can still gain access to such hydrocyclones for servicing from the interior of the apparatus.

There is no passageway through reject manifold 36'. To permit entry of an operator into walkway space 64' without removal of any of the hydrocyclones, a permanent gap is provided in each of the hydrocyclone arrays, such gaps being aligned with one another to provide a passageway 92 through the hydrocyclone arrays from the periphery of the device.

Figure 6:
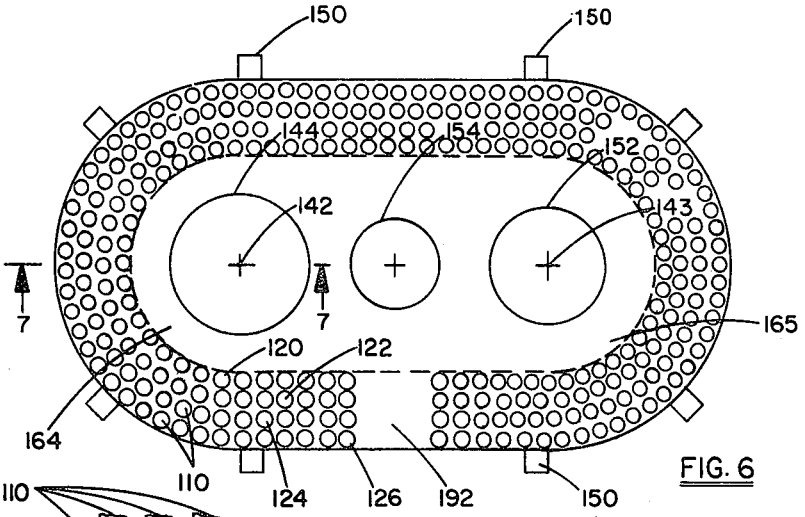
FIG. 6 is a sectional view taken along line 6—6 in FIG. 5.
Figure 7:
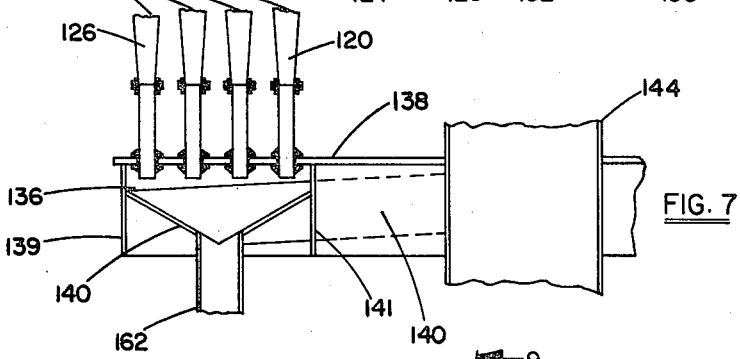
FIG. 7 is a fragmentary sectional view taken along line 7—7 in FIG. 6.
Figure 5:
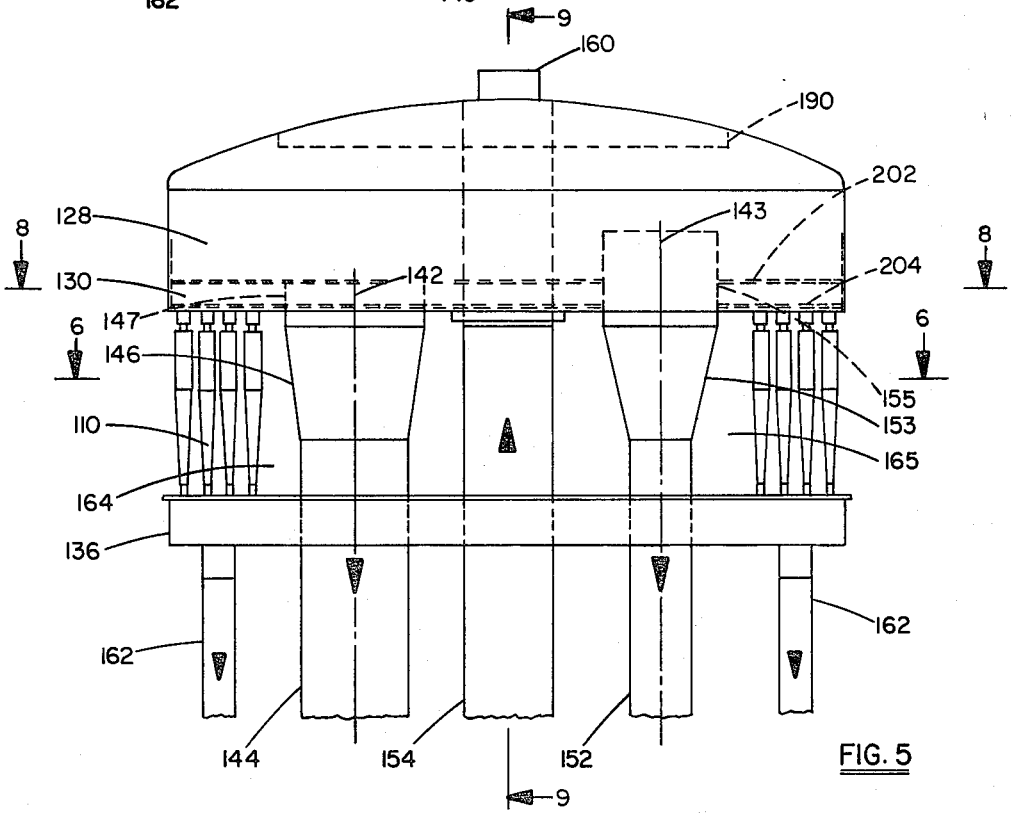
FIG. 5 is an elevational view of apparatus according to a third embodiment of the present invention with portions of such apparatus omitted for purposes of illustration.

The apparatus illustrated in FIGS. 5 through 10 includes four loop-like arrays 120, 122, 124, and 126 of hydrocyclones 110. The hydrocyclone arrays in this apparatus are not circular but instead are obround, the poles of each of the arrays being disposed at locations 142 and 143. The apparatus also includes an obround feed plenum 130 disposed above the hydrocyclones, an obround accept plenum 128 disposed above the feed plenum and a reject manifold 136 in the form of an obround annular plenum, the reject plenum being disposed beneath the hydrocyclones and structurally connected to accept plenum 128 by braces 150 (FIG. 6). Braces 150 may extend beneath the reject plenum to support the apparatus in an elevated location above the floor of the mill. As best seen in FIG. 7, reject plenum 136 includes an outer skirt 139, an inner wall 141, a planar top wall 138 which extends beyond inner wall 141 and a V-shaped bottom wall 140. The poles of each of the obround plenums are aligned with the corresponding poles of the hydrocyclone arrays.

An accept outlet pipe or conduit 144 extends through the space bounded by innermost hydrocyclone array 120 in alignment with pole 142 of the obround arrays and in alignment with the corresponding pole of obround accept plenum 128. Tapering transition section 146 is provided adjacent the juncture of accept outlet pipe 144 with accept plenum 128, a short, straight connecting section 147 intervening between transition section 146 and the accept plenum 128. Accept outlet pipe 144 and the adjacent hydrocyclones of innermost array 120 define a first walkway space 164 which space, when seen in plan as in FIG. 6, is generally U-shaped, the open end of the U-shape facing toward pole 143.

Accept overflow pipe 152 extends vertically in alignment with pole 143 of the hydrocyclone arrays, such pipe having a funnel-like transition piece 153 being provided adjacent its upper end and a straight inet section 155 extending upwardly from transition piece 153 into plenum 128. Pipe 152 and the adjacent hydrocyclones of innermost array 120 define a second walkway space 165 which, as viewed in plan, is generally U-shaped with the open end of the U facing towards pole 142. The two walkway spaces 164 and 165 are contiguous with one another and, in effect, constitute a single continuous walkway space in the form of an obround loop immediately adjacent the innermost array of hydrocyclones. Two reject outlet pipes 162 are connected to reject plenum 136, one such pipe being provided at each end of the apparatus. A vacuum connection pipe 160 communicates with accept plenum 128. A skirt 190 (FIG. 9) surrounds the vacuum connection.

The portions of reject plenum top wall 138 underlying walkway spaces 164 and 165 provide a floor for such spaces so that an operator can stand on wall 138 while servicing the inner hydrocyclones. Each of the hydrocyclone arrays is provided with a gap on one long side adjacent the lateral medial plane of the apparatus, the gaps being aligned with one another to provide an access passageway 192 for entry of an operator into the walkway spaces 164 and 165.

Figure 9:
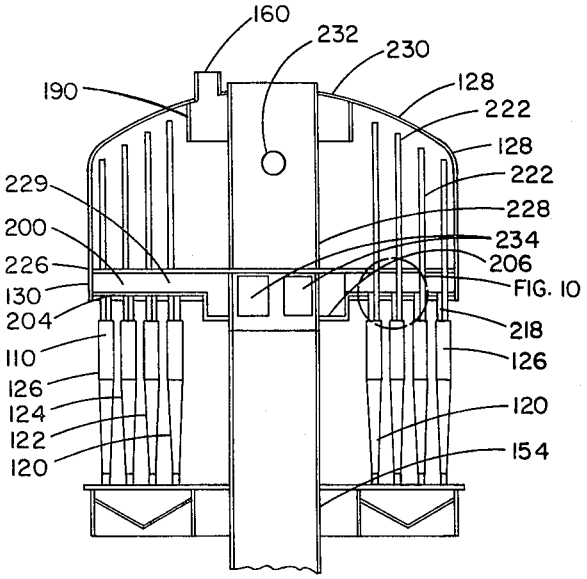
FIG. 9 is a sectional view taken along line 9—9 in FIG. 8.
Figure 8:
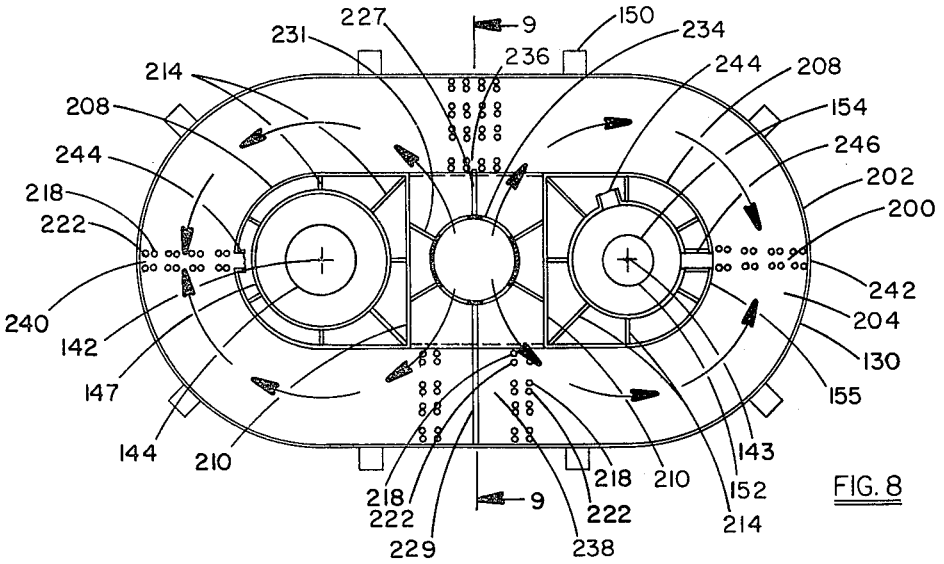
FIG. 8 is a sectional view taken along line 8—8 in FIG. 5.

A feed pipe 154 extends upwardly to feed plenum 130 adjacent the middle of the apparatus, between accept outlet pipe 144 and accept overflow pipe 152. As best seen in FIGS. 8 and 9, feed manifold 130 includes a loop-like peripheral portion 200 adjacent the peripheral wall 202 of the feed plenum. Peripheral portion 200 overlies the hydrocyclone arrays 120–126 (FIG. 6) in alignment therewith. The bottom walfl 204 of the feed plenum is substantially planar throughout peripheral portion 200, but bottom wall 204 includes a depressed section 206 adjacent the middle of the apparatus in the vicinity of feed pipe 154. Two generally U-shaped circumferential baffles 208 are disposed within plenum 130, each such circumferential baffle extending along the inner boundary of feed plenum peripheral portion 200. A straight baffle 210 is joined to each of the circumferential baffles so that each circumferential baffle and the straight baffle associated therewith cooperatively constitute a generally D-shaped continuous baffle. The two D-shaped continuous baffles are disposed back to back, with their respective straight portions 210 confronting one another on either side of feed pipe 154. Baffles 208 and 210 extend vertically between the bottom and top walls of the feed plenum so that each of the continuous D-shaped baffles completely encloses the space contained within it. The inlet section 155 of overflow pipe 152 extends upwardly through the space enclosed by one of the D-shaped baffles and the inlet section 147 of accept outlet pipe 144 extends through the space bounded by the other D-shaped baffle. A plurality of braces 214 are disposed within the spaces bounded by the D-shaped baffles. Each of the braces also extends between the top and bottom walls of the feed plenum so that the baffles reinforce the top and bottom walls of the feed plenum within the areas bounded by the D-shaped baffles.

Figure 10:
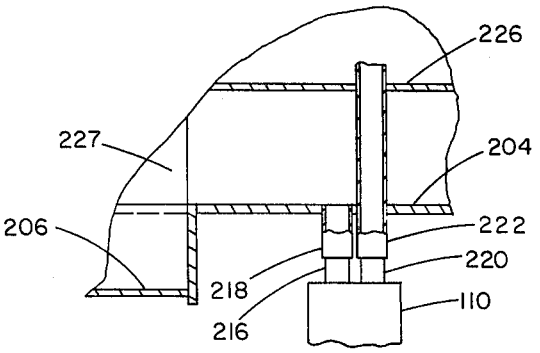
FIG. 10 is a fragmentary view on an enlarged scale showing the portions of the apparatus indicated in FIG. 9.

As best seen in FIGS. 9 and 10, the feed inlet 216 of each hydrocyclone 110 communicates with the peripheral portion of feed plenum 130 via an inlet nipple 218, each such nipple being mounted in a cyclindrical hole extending through the planar portion of feed plenum bottom wall 204. The accept outlet 220 of each hydrocyclone communicates with the interior of accept plenum 128 via an accept spray pipe 222 extending upwardly through the feed plenum into the accept plenum. Each spray pipe is welded to feed plenum bottom wall 204 and feed plenum top wall 226. The accept spray pipes thus structurally interconnect and reinforce walls 204 and 226 of feed plenum 130. Additional reinforcement is provided in the vicinity of feed pipe 154 by plates 227, 229 and 231 extending radially outwardly from the feed pipe. As the spray pipes provide adequate reinforcement in the peripheral portion of the feed plenum, plate 227 terminates just inwardly of the peripheral portion. However, the zone of the peripheral portion overlying access passageway 192 (FIG. 6) is devoid of spray pipes. Consequently, plate 229 (FIGS. 8 and 9) extends into this zone of the peripheral portion to provide reinforcement in this area.

As top wall 226 of feed plenum 130 also serves as the bottom wall of accept plenum 128, and as the accept plenum is maintained under vacuum during operation of the apparatus, wall 226 is subjected to substantial collapsing forces during operation, but the reinforcement provided by the spray pipes, baffles, plates and braces aids in resisting these collapsing forces. The top and bottom walls of accept plenum 128 are further reinforced by a support pipe 228 extending from wall 226 to the top wall 230 of the accept plenum in alignment with feed pipe 154. The interior of support pipe 228 does not communicate with the interior of accept plenum 128 or with feed pipe 154. The top end of the support pipe is left open to the exterior of the apparatus and sight glasses 232 (of which only one is visible in FIG. 9) are provided in the wall of the support pipe so that an operator may enter into the support pipe and observe conditions within the accept plenum during operation of the apparatus.

During operation of the apparatus, feed stock enters the central portion of feed plenum 130 from feed pipe 154 via apertures 234 in the wall of the feed pipe. The entering stock passes along two oppositely directly branch flow courses, between baffles 210 toward the sides of the apparatus. One such course extends towards the top of the page as seen in FIG. 9 and the other extends towards the bottom of the page. The feed stock flowing in one of the branch flow courses enters the peripheral portion of the feed manifold at inlet location 236 and the feed stock flowing along the other branch flow course enters the peripheral portion at inlet location 238 on the opposite side of the apparatus. The feed stock entering the peripheral portion of the feed plenum at each inlet portion splits into two oppositely directly streams, each such stream flowing away from such inlet location around the loop towards the other inlet location. For example, stock entering the peripheral portion at inlet location 236 forms a first stream directed counter-clockwise around the loop towards inlet location 238 and a second stream directed clockwise around the loop-like peripheral portion towards inlet location 238. As each of these flow streams in the peripheral portion passes around the loop, portions of the flow stream pass into the hydrocyclones via the inlet nipples 218. Consequently, the volume of stock in each such flow stream diminishes as the flow stream passes away from its point of origin.

The oppositely directed flow streams moving around the loop-like peripheral portion meet one another head on at juncture locations 240 and 242 adjacent the ends of the apparatus. Bleed pipes 244 and 246 communicate with the peripheral portion of the manifold adjacent juncture locations 240 and 242 respectively. Both of the bleed pipes communicate with accept overflow pipe 152 so that stock reaching the juncture locations 240 and 242 will pass out of the feed plenum via the bleed pipes and blend with the overflowing accepted stock for subsequent reprocessing.

Such diversion of a minor portion of the feed stock from the feed plenum prevents stagnation of the feed stock at the juncture locations and helps to maintain sufficient flow velocity throughout the peripheral portion of the feed plenum to prevent setting lor segregation of the feed stock in the plenum. Thus, even though the flow volume and, hence, the velocity of each flow stream decreases as such stream moves away from its inlet location and towards one of the juncture locations, such velocity never falls below the desired minimum value. It is therefore unnecessary to provide the feed plenum in this embodiment with a tapering or gradually decreasing cross-sectional area to maintain the flow velocity. Thus, the feed plenum can be fabricated with simple planar top and bottom walls in the peripheral section. The cylindrical holes in the feed plenum bottom wall necessary to accommodate the inlet nipples and spray pipes can be formed readily and accurately during manufacture of the apparatus without the difficulties encountered in drilling such holes through a non-planar surface. Those of inlet nipples 218 which are disposed adjacent the ends of the apparatus, i.e., adjacent juncture locations 240 and 242, extend upwardly into feed plenum 130. Such upwardly extending inlet nipples serve to remove any pockets of air which may accumulate in the upper portion of the feed plenum. Because such upwardly-extending inlet nipples are disposed in regions of relatively low flow velocity in the feed plenum, they do not substantially impair the flow of feed stock in the plenum.

As set forth above, the use of a flow pattern wherein stock entering the peripheral portion of the feed plenum is directed in oppositely-directed streams, and the removal of a minor portion of the stock at the juncture locations where these steams meet one another, provides significant advantages. Similar advantages can be obtained by use of these features in apparatus of various different configurations. Merely by way of example, these two features can be used with round apparatus similar to that described above with reference to FIGS. 1–4. Also, more than two separate inlet locations can be utilized. If desired, a separate feed pipe can be connected to each inlet location.

The particular embodiments described above may be utilized, for example, in cleaning and deaerating paper stock. For apparatus to be used with paper stock, the preferred material of fabrication for the plenum and pipes is austenitic stainless steel. Although the particular hydrocyclones utilized in the apparatus may be varied according to the application, one type of hydrocyclone which may be utilized is described in U.S. Pat. No. 4,148,721.

The dimensions of the apparatus will vary with the number and type of hydrocyclones employed. A typical installation according to the embodiment described above with reference to FIGS. 5 through 10 may be about 22 feet long and about 12 feet wide, and may include about 200 hydrocyclones. As noted above, the walkway space and access passageway must be large enough to permit entry of a human operator. Although an operator can enter openings as small as about 18 inches wide and 18 inches high, larger clearances are preferred. A typical embodiment includes a walkway space about 18 inches wide at the bottom, about 5 feet high and tapering gradually to a width of about 12 inches at the top.

As will be readily appreciated, numerous variations and combinations of the features described above may be utilized without departing from the present invention. Thus, although each of the manifolds in the apparatus described above is a unitary chamber or plenum, manifolds consisting of a network of interconnected pipes may be utilized in place of the feed and reject plenums, and such pipe manifolds may also be used in place of the accept plenum in apparatus which does not incorporate the spray arrangement described above for deaeration. As will be readily appreciated, pipe network manifolds disposed beneath and above the hydrocyclone arrays tend to impede access to the inner hydrocyclone arrays in the same manner as do plenum-type manifolds, but the walkway space and access means of the present invention will alleviate this difficulty regardless of whether plenum or pipe network manifolds are used.

Also, although the particular hydrocyclones referred to above and illustrated in the drawings are of the "top inlet" type having an inlet opening at an end of the hydrocyclone body, other forms of hydrocyclone may also be utilized. For example, certain hydrocyclones have their inlet openings on the peripheral wall of the body. Such hydrocyclones are normally mounted with the body projecting into the feed manifold so that the inlet opening communicates directly with the interior of the feed manifold. Appropriate seals, such as elastomeric rings, are provided to form a water-tight and air-tight joint between the peripheral wall of the cleaner body and the surrounding portions of the feed manifold wall.

Although all of the arrangements described above have been arranged to accept the lighter fraction of the stock from each hydrocyclone and reject the heavier fraction, the reverse action may be desirable for separating relatively low density contaminates from the stock, and the present invention is equally applicable to apparatus incorporating such reverse action.

As these and other variations and combinations of the features described above can be utilized, the foregoing description of various embodiments should be taken by way of illustration rather than by way of limitation of the present invention as set forth in the claims.

What is claimed is:

1. Multiple hydrocyclone apparatus of the type having:

(a) a plurality of elongated, vertically extensive hydrocyclones disposed side by side in a plurality of loop-like arrays, said plurality of arrays including an innermost array and at least one outer array surrounding said innermost array;

(b) means for conducting feed stock to the inlets of said hydrocyclones;

(c) means for conducting rejected stock from the reject outlets of said hydrocyclones, such means including a reject manifold disposed below said hydrocyclones; and (d) means for conducting accepted stock from the accept outlets of said hydrocyclones, such means including an accept plenum disposed above said hydrocyclones, means for maintaining a partial vacuum within said accept plenum, means for spraying accepted stock from the accept outlets of said hydrocyclones into said accept plenum and an accept outlet pipe communicating with said accept plenum and extending downwardly therefrom in the space bounded by the innermost one of said arrays of hydrocyclones;

wherein the improvement comprises disposition of said innermost array and said accept outlet pipe to provide a clearance between such pipe and the hydrocyclones of said innermost array so that said accept outlet pipe and said innermost row of hydrocyclones cooperatively define a walkway space of sufficient size to accommodate a human operator and means for permitting entry of a human operator to said walkway space during operation of the hydrocyclones without removal of any of said hydrocyclones, said accept outlet pipe including an outwardly flaring transition section adjacent said accept plenum, the wide end of said transition section being disposed at the top thereof, said transition section extending outwardly of said accept outlet pipe above said walkway space.

2. Apparatus as claimed in claim 1 wherein said transition section serves as a reinforcing structure.

3. Apparatus as claimed in claim 1 in which the top surface of said reject manifold serves as a floor for said walkway space.

4. Apparatus as claimed in claim 1 wherein said means for permitting entry to said walkway space includes a single gap extending through all of said arrays of hydrocyclones.

5. Apparatus as claimed in claim 1 wherein said accept plenum is round in plan, each of said arrays of hydrocyclones is round in plan, the centers of said arrays being aligned with the center of said accept plenum, said accept outlet pipe also being aligned with the center of said accept plenum.

6. Apparatus as claimed in claim 5 wherein said accept outlet pipe physically supports said accept plenum.

7. Apparatus as claimed in claim 6 wherein said accept outlet pipe extends downwardly beyond said reject manifold.

8. Apparatus as claimed in claim 5 wherein said accept conducting means also includes an accept overflow pipe extending within said accept outlet pipe.

9. Apparatus as claimed in claim 5 or claim 8 wherein said feed conducting means includes a feed inlet pipe extending within said accept outlet pipe to the vicinity of said feed manifold and at least one radial feed pipe extending outwardly from said feed inlet pipe to said feed manifold, each such radial feed pipe communicating with said feed inlet pipe and said feed manifold.

10. Apparatus as claimed in claim 1 wherein said feed conducting means includes a feed manifold disposed below said accept plenum and adjacent thereto.

11. Apparatus as claimed in claim 10 in which said accept plenum is dipolar in plan, said arrays of hydrocyclones also being dipolar in plan, said accept plenum being aligned with said arrays so that the poles of each of said arrays are aligned with the poles of said accept plenum.

12. Apparatus as claimed in claim 11 in which said accept outlet pipe is disclosed in alignment with one pole of said accept plenum, said accept-conducting means further comprising an accept overflow pipe aligned with the opposite pole of said accept plenum extending downwardly from said accept plenum through said feed manifold and through the space bounded by said innermost array of hydrocyclones, there being a clearance between said accept overflow pipe and the adjacent hydrocyclones of said innermost array so that said accept overflow pipe and such adjacent hydrocyclones cooperatively define a second walkway space, said second walkway space communicating with said first walkway space.

13. Apparatus as claimed in claim 12 wherein said accept overflow pipe includes an outwardly flaring transition section adjacent said accept plenum, the wide end of such transition section being disposed at the top thereof, the transition section of said accept overflow pipe extending outwardly of said accept overflow pipe above said second walkway space.

14. Apparatus as claimed in claim 12 wherein said feed conducting means includes a feed inlet pipe extending downwardly from said feed manifold between said accept outlet pipe and said accept overflow pipe.

15. Apparatus as claimed in claim 12 or claim 13 or claim 14 wherein accept overflow pipe and said accept outlet pipe physically support said accept plenum.

16. Apparatus as claimed in claim 15 wherein said accept overflow pipe and said accept outlet pipe extend downwardly beyond said reject manifold.

17. Apparatus as claimed in claim 16 wherein said accept plenum is obround in plan, each of said arrays of hydrocyclones also being obround in plan.

18. Multiple hydrocyclone apparatus of the type having:

(a) a plurality of elongated, vertically-extensive hydrocyclones disposed side by side in a plurality of horizontally-extensive loop-like arrays, said plurality of arrays including an innermost array and at least one outer array surrounding said innermost array;

(b) means for conducting rejected stock from the reject outlets of said hydrocyclones;

(c) means for conducting accepted stock from the accept outlets of said hydrocyclones;

(d) a horizontally-extensive feed manifold including a central portion and a loop-like peripheral portion aligned with said hydrocyclone arrays, the feed inlet of each of said hydrocyclones communicating with the peripheral portion of said feed manifold, wherein the improvement comprises:

(e) means for introducing feed stock to the peripheral portion of said feed manifold at a plurality of inlet locations remote from one another and directing the feed stock from each such inlet location along said peripheral portion towards another one of said inlet locations, so that stock flowing from each of said inlet locations meets stock flowing from another one of said inlet locations at a juncture location on said peripheral portion of said feed manifold, there being at least two such juncture locations on said feed manifold; and (f) means for bleeding a portion of the feed stock from said feed manifold adjacent each of said juncture locations.

19. Apparatus as claimed in claim 18 wherein said means for introducing feed stock to said peripheral portion includes a feed pipe connected to said feed manifold at a location within the inner boundary of said peripheral portion and means for directing feed stock from said feed pipe to said inlet locations along a plurality of separate branch flow courses.

20. Apparatus as claimed in claim 19 in which said manifold is a plenum having a top wall and a bottom wall, each of said flow-directing means including baffles disposed within said plenum, each such baffle extending from said top wall to said bottom wall.

21. Apparatus as claimed in claim 20 wherein said feed plenum is disposed above said hydrocyclone arrays, the portion of said bottom wall underlying said peripheral portion being substantially planar, the feed inlet of each of said hydrocyclones communicating with said peripheral portion via a cylindrical hole in said planar portion of said bottom wall.

22. Apparatus as claimed in claim 20, wherein said baffles include at least one continuous baffle surrounding a portion of said plenum and excluding feed stock therefrom.

23. Apparatus as claimed in claim 22 including two of said branch flow courses and two of said continuous baffles, each of said continuous baffles being generally D-shaped, said D-shaped continuous baffles being disposed in back-to-back orientation within said plenum, the straight portion of each D-shaped continuous baffle being disposed adjacent said feed pipe.

24. Apparatus as claimed in claim 22 further comprising a plurality of braces extending between the said top and bottom walls of said feed plenum within the portions of said plenum surrounded by said continuous baffle.

25. Apparatus as claimed in claim 22 wherein said accepted stock conducting means includes an accept manifold disposed above said feed plenum and at least one conduit extending downwardly through a portion of said feed plenum surrounded by said continuous baffle.

26. Apparatus as claimed in claim 18 in which said hydrocyclone arrays and the peripheral portion of said feed manifold are in the form of elongated loops, there being two of said inlet locations, said inlet locations being on opposite long sides of said elongated loops, said juncture locations being adjacent opposite ends of said loops.

27. Apparatus as claimed in claim 26 in which said hydrocyclone arrays and the peripheral portion of said feed manifold are in the form of obround loops.

* * * * *

UNITED STATES PATENT AND TRADEMARK OFFICE

CERTIFICATE OF CORRECTION

PATENT NO. : 4,437,984
DATED : March 20, 1984
INVENTOR(S) : King et al

It is certified that error appears in the above—identified patent and that said Letters Patent is hereby corrected as shown below:

Column 6, line 60, "plaenum" should read --plenum--.

Column 7, line 4, "psaaageway" should read --passageway--.

Column 10, line 51, "reject" should read --reject--.

Column 11, line 3, "walfl" should read --wall--.

Column 11, line 35, "cyclindrical" should read --cylindrical--.

Column 12, line 20, "portion" should read --location--.

Column 12, line 49, "setting lor" should read --settling or--.

Column 13, line 11, "steams" should read --streams--.

Signed and Sealed this

Tenth Day of July 1984

[SEAL]

*Attest:*

GERALD J. MOSSINGHOFF

*Attesting Officer*

*Commissioner of Patents and Trademarks*